US007798530B1

(12) United States Patent
Mercado

(10) Patent No.: US 7,798,530 B1
(45) Date of Patent: Sep. 21, 2010

(54) BOOKMARK AND STAND

(76) Inventor: Michael Mercado, 12867 SW. 151 La., Miami, FL (US) 33186

( * ) Notice: Subject to any disclaimer, the term of this patent is extended or adjusted under 35 U.S.C. 154(b) by 0 days.

(21) Appl. No.: 12/701,822

(22) Filed: Feb. 8, 2010

(51) Int. Cl.
*B42D 9/00* (2006.01)
*A47B 97/04* (2006.01)

(52) U.S. Cl. ..... 281/42; 248/459

(58) Field of Classification Search ..... 248/495; 116/237, 234; 281/42, 45; 283/81, 100, 283/101, 103, 105
See application file for complete search history.

(56) References Cited

U.S. PATENT DOCUMENTS 3,701,332 A * 10/1972 Brooks ..... 281/42
5,868,373 A * 2/1999 Duff ..... 248/459
2004/0113037 A1* 6/2004 Lane ..... 248/459

* cited by examiner

*Primary Examiner*—Dana Ross
*Assistant Examiner*—Pradeep C Battula
(74) *Attorney, Agent, or Firm*—Albert Bordas, P.A.

(57) ABSTRACT

A bookmark and stand, comprising first and second flaps and a bridge assembly. The first and second flaps each comprise a wall section, a base section, and a hook section. The bridge assembly comprises a top edge, a bottom edge, and a bridge. The bridge assembly connects to rear edges. The first and second flaps have a sheet configuration and are made of a substantially rigid material to support a book when in a bookstand configuration, and also may lay flat within the book when in a bookmark configuration, whereby the first and second flaps and the bridge assembly conform to a shape of the book and are thin enough so as to not damage the book.

5 Claims, 4 Drawing Sheets

BOOKMARK AND STAND

BACKGROUND OF THE INVENTION

1. Field of the Invention

The present invention relates to book accessories, and more particularly, to a bookmark that also serves as a bookstand.

2. Description of the Related Art

Book accessories serve a variety of functions to increase reader comfort and pleasure while reading. As an example, bookmarks are well known in the art. They include simple strips of ribbon, which rest in between leaves of a book, to complicated mechanical clamps. However, once a person starts reading, the bookmark is no longer needed. Another accessory is a bookstand, often used to showcase or display a book. Typical bookstands are bulky and heavy. Applicant is not aware of any simple and efficient bookmark, which can be economically manufactured and have the ability to also serve as a bookstand.

SUMMARY OF THE INVENTION

The instant invention is a bookmark and stand, comprising first and second flaps and a bridge assembly. The first and second flaps each comprise a wall section, a base section, and a hook section. The wall section is defined by a base edge, a rear edge, a first top edge, a first inclined edge, and a second inclined edge. The base section is defined by its respective base edge and an intermediate edge. The bridge assembly comprises a second top edge, a bottom edge, and a bridge. The bridge assembly connects to each the rear edge. The first and second flaps have a sheet configuration and are made of a substantially rigid material to support a book when in a bookstand configuration, and also may lay flat within the book when in a bookmark configuration, whereby the first and second flaps and the bridge assembly conform to a shape of the book and are thin enough so as to not damage the book. The base edge is straight.

Extending upwardly and approximately perpendicularly from an end of each base edge is its respective rear edge. Extending approximately perpendicularly from each rear edge is its respective first top edge. Each first top edge extends downwardly to its respective first inclined edge that in turn also extends downwardly to its respective second inclined edge. Each intermediate edge extends from its respective second inclined edge to its respective interior edge of its respective hook section. Each base edge and its respective intermediate edge are parallel. Each hook section comprises an interior edge, a bottom hook edge, a tip, a top hook edge, a front edge, and its respective base edge. Each interior edge extends upwardly at a predetermined angle to its respective bottom hook edge, and each front edge is approximately perpendicular to its respective base edge. In a preferred embodiment, the first and second flaps are a mirror image of each other.

The first inclined edges are substantially perpendicular to its respective interior edges to provide a comfortable angle and support for the book. Each base edge is longer in length than its respective rear edge. Each base edge is longer in length than its respective top edge. Each base edge is longer in length than its respective first inclined edge. Each base edge is longer in length than its respective second inclined edge. Each base edge is longer in length than its respective intermediate edge.

The bridge assembly is made of a flexible material. This allows the first and second flaps and the bridge assembly to conform to a shape of the book. The first and second flaps and the bridge assembly are thin enough so as to not damage the book while flat within the book when in a bookmark configuration. Each hook section has a cooperative shape and dimension to secure the book in place when in a bookmark configuration. Each interior edge has cooperative dimensions to allow the book of various widths to rest upon them as the book also rests on the inclined edges.

It is therefore one of the main objects of the present invention to provide a simple and efficient bookmark, which can be economically manufactured and have the ability to also serve as a bookstand.

It is another object of this invention to provide a bookmark and stand that conforms to the shape of a book.

It is another object of this invention to provide a bookmark and stand that is volumetrically efficient for carrying, transporting, and storage.

It is another object of this invention to provide a bookmark and stand that can be readily assembled and disassembled without the need of any special tools.

It is another object of this invention to provide a bookmark and stand that is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
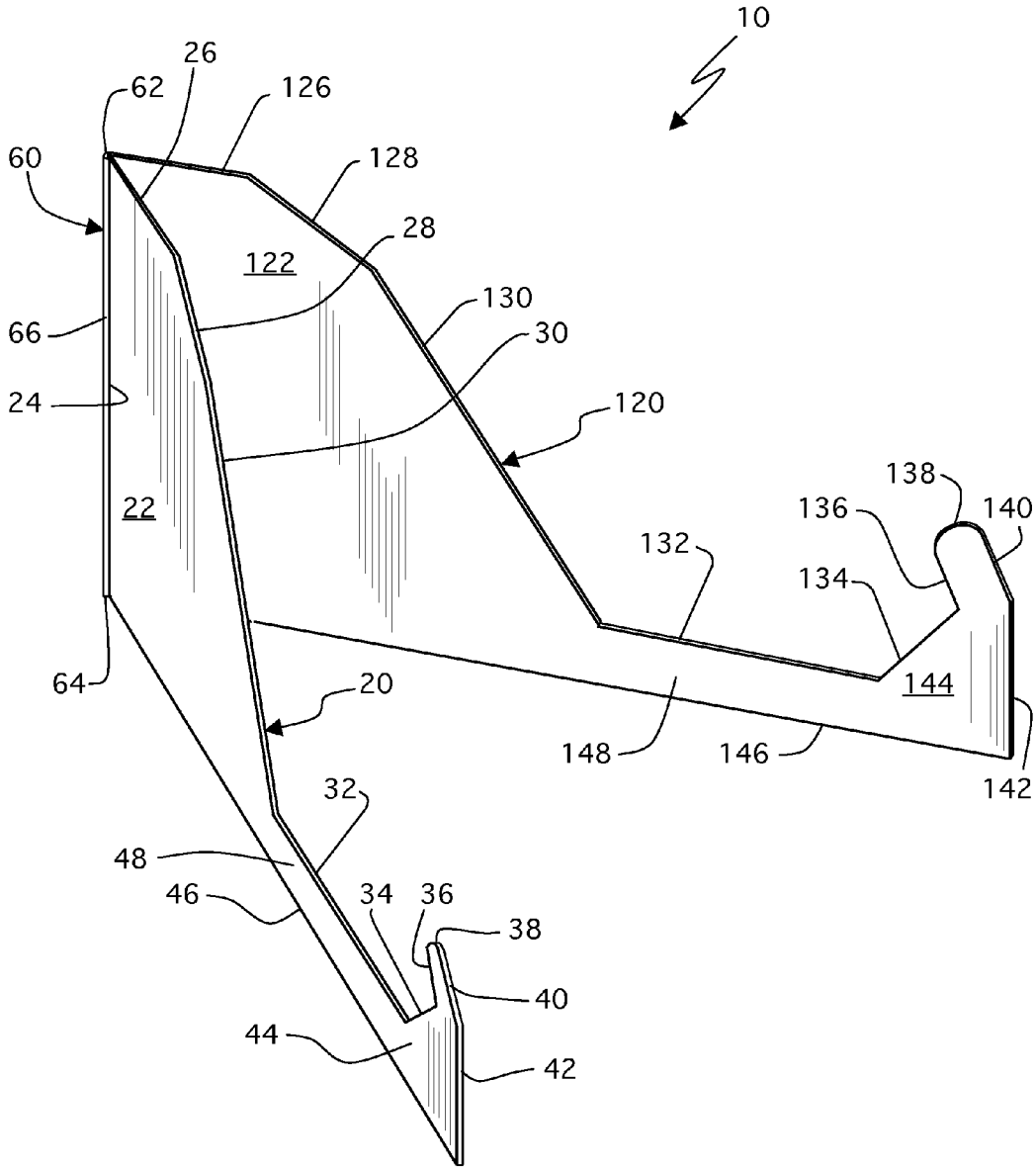
FIG. 1 is an isometric view of the instant invention in a bookstand configuration.

Referring now to the drawings, the present invention is generally referred to with numeral 10. It can be observed that it basically includes flaps 20 and 120, and bridge assembly 60.

As seen in FIG. 1, flap 20 comprises wall section 22, base section 48, and hook section 44.

Wall section 22 is primarily defined by base edge 46, rear edge 24, top edge 26, inclined edge 28, and inclined edge 30.

In a preferred embodiment, base edge 46 is straight and lies flat on a surface. Extending upwardly and approximately perpendicularly from a first end of base edge 46 is rear edge 24. Extending approximately perpendicularly from rear edge 24 is top edge 26. Top edge 26 extends downwardly to inclined edge 28 that in turn also extends downwardly to inclined edge 30. Base section 48 is primarily defined by base edge 46 and intermediate edge 32. In a preferred embodiment, intermediate edge 32 extends from inclined edge 30 to interior edge 34 of hook section 44. In a preferred embodiment, base edge 46 and intermediate edge 32 are parallel. Hook section 44 is primarily defined by interior edge 34, bottom hook edge 36, tip 38, top hook edge 40, front edge 42, and base edge 46. In a preferred embodiment, interior edge 34 extends upwardly at a predetermined angle to bottom hook edge 36, and front edge 42 is approximately perpendicular to base edge 46.

In a preferred embodiment, flap 20 is a mirror image of flap 120. Similarly to flap 20 defined above, flap 120 comprises wall section 122, base section 148, and hook section 144.

Figure 3:
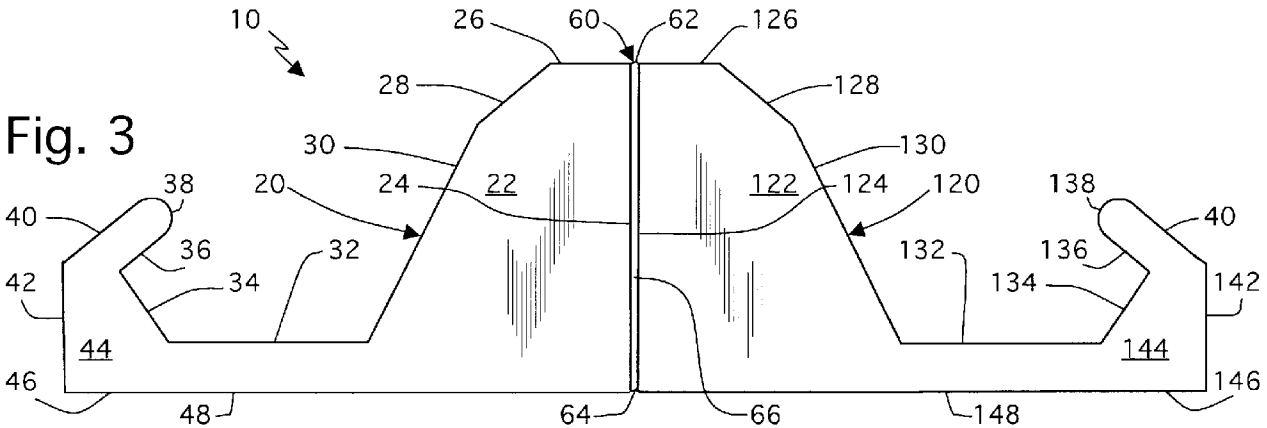
FIG. 3 is a front isometric view of the instant invention.

Wall section 122 is primarily defined by base edge 146, rear edge 124, seen in FIG. 3, top edge 126, inclined edge 128, and inclined edge 130.

In a preferred embodiment, base edge 146 is straight and lies flat on a surface. Extending upwardly and approximately perpendicularly from a first end of base edge 146 is rear edge 124. Extending approximately perpendicularly from rear edge 124 is top edge 126. Top edge 126 extends downwardly to inclined edge 128 that in turn also extends downwardly to inclined edge 130. Base section 148 is primarily defined by base edge 146 and intermediate edge 132. In a preferred embodiment, intermediate edge 132 extends from inclined edge 130 to interior edge 134 of hook section 144. In a preferred embodiment, base edge 146 and intermediate edge 132 are parallel. Hook section 144 is primarily defined by interior edge 34, bottom hook edge 136, tip 138, top hook edge 140, front edge 142, and base edge 146. In a preferred embodiment, interior edge 134 extends upwardly at a predetermined angle to bottom hook edge 136, and front edge 142 is approximately perpendicular to base edge 146.

Figure 2:
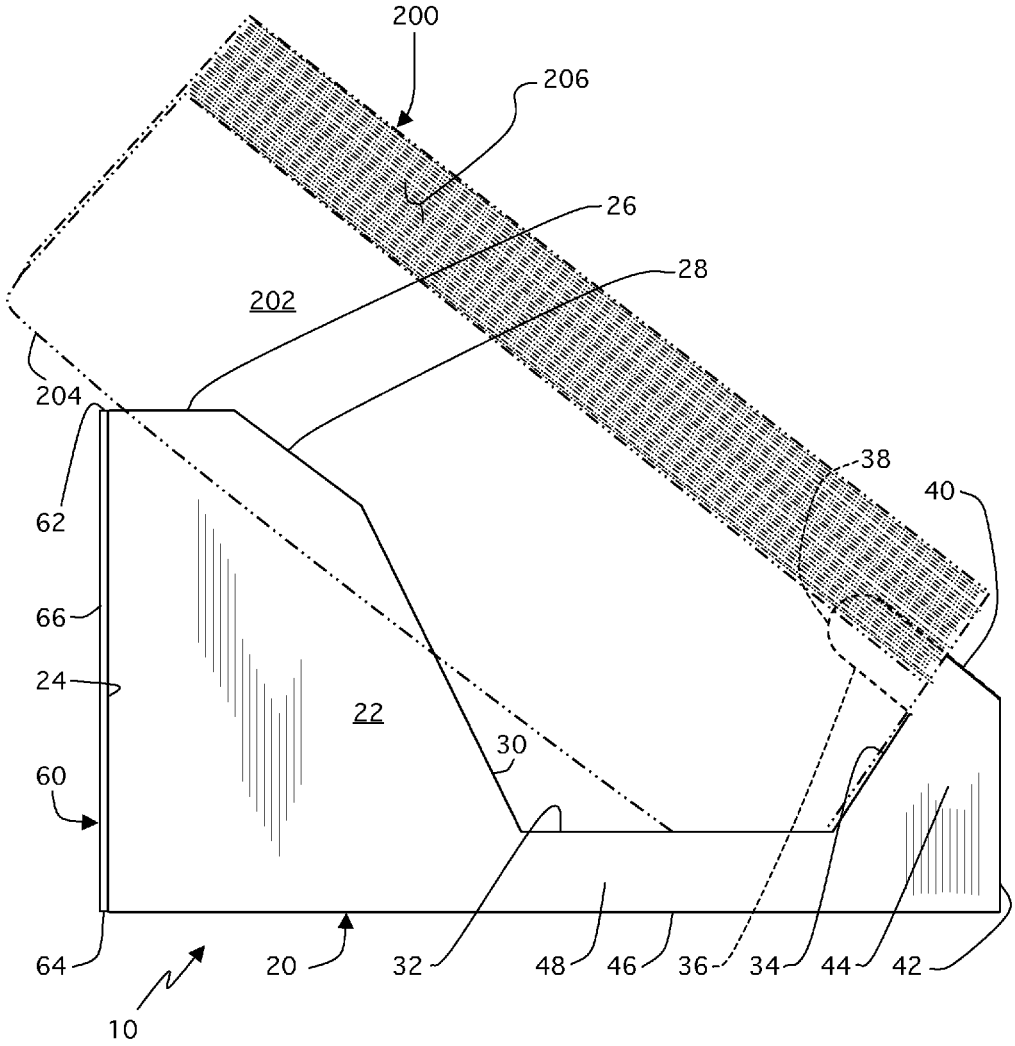
FIG. 2 is a side elevational view of the instant invention in the bookstand configuration with a book placed thereon.

Flaps 20 and 120 have a sheet configuration and are preferably made of a substantially rigid material to support a book 200 when instant invention 10 is in a bookstand configuration as seen in FIG. 2. It is noted that inclined edges 28 and 128 are substantially perpendicular to interior edges 34 and 134 to provide a comfortable angle and support for book 200. Book 200 generally comprises front and rear flaps 202, seen in FIG. 6, that are joined by spine 204. Book 200 also end papers 206.

Figure 4:
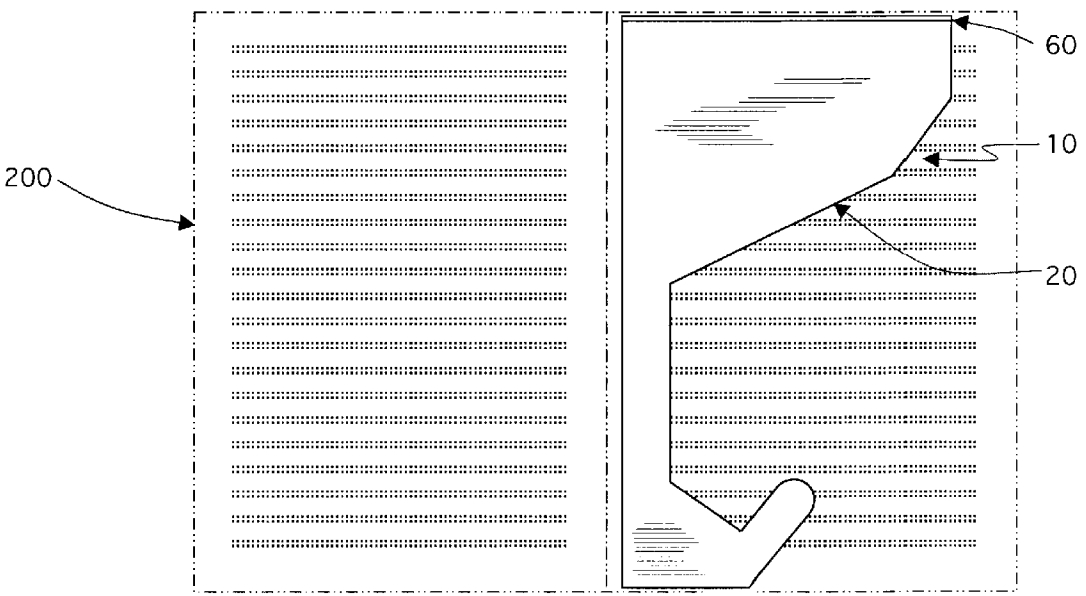
FIG. 4 is a front isometric view of the instant invention in a bookmark configuration.
Figure 6:
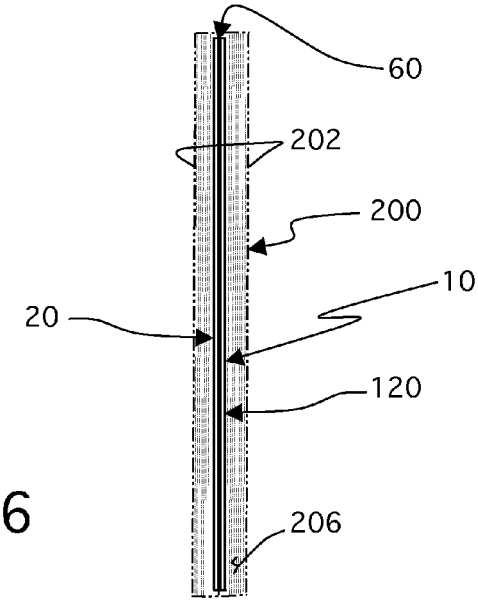
FIG. 6 is a front isometric view of the invention in the bookmark configuration and inserted within a book.

As seen in FIG. 3, bridge assembly 60 comprises top edge 62, bottom edge 64 and bridge 66. Bridge assembly 60 connects rear edge 24 to rear edge 124. As best seen in this illustration, base edges 48 and 148 are longer in length than rear edges 24 and 124 respectively. Base edges 48 and 148 are also longer in length than top edges 26 and 126 respectively. Base edges 48 and 148 are also longer in length than inclined edges 28 and 128 respectively. Base edges 48 and 148 are also longer in length than inclined edges 30 and 130 respectively, and base edges 48 and 148 are also longer in length than intermediate edges 32 and 132 respectively. Bridge assembly 60 is made of a flexible material to allow instant invention 10 to lay flat within book 200 when in the bookmark configuration as seen in FIGS. 4 and 6. In an alternate embodiment, bridge assembly 60 may be a hinge assembly such as a butt hinge secured onto book 200.

Figure 5:
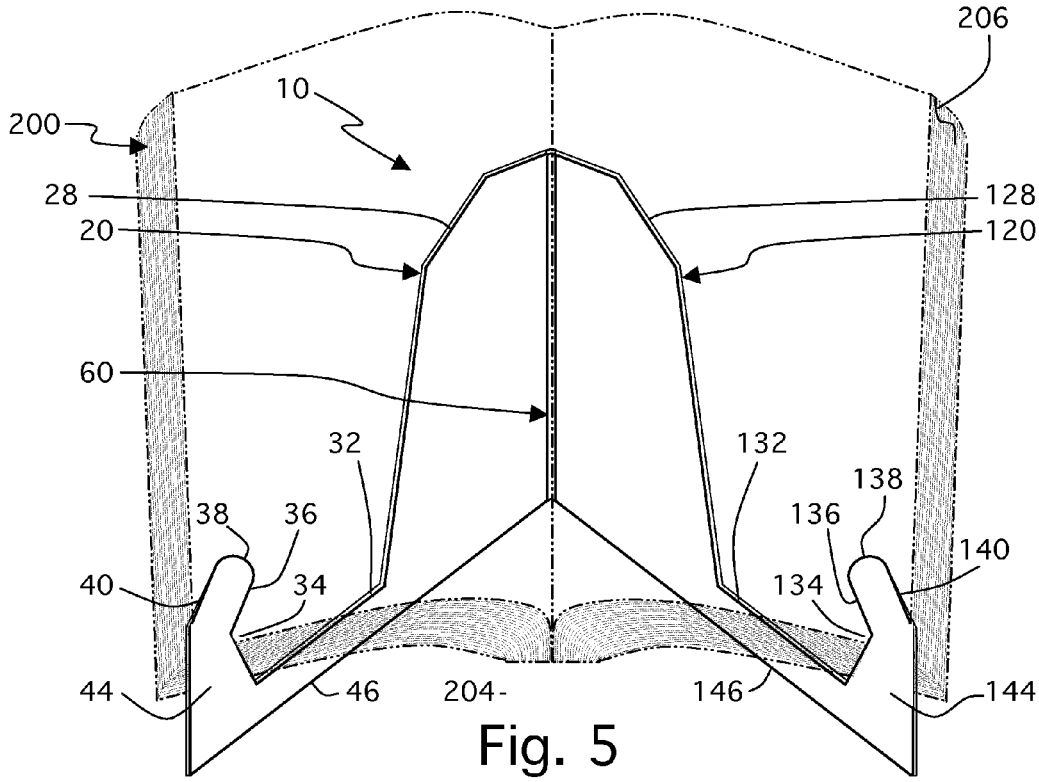
FIG. 5 is a front isometric view of the instant invention in the bookstand configuration with a book placed thereon.

As seen in FIG. 5, hook sections 44 and 144 have a cooperative shape and dimensions to secure book 200 in place when instant invention 10 is in the bookmark configuration. Specifically, interior edges 34 and 134 have cooperative dimensions to allow books, such as book 200, of various widths to rest upon them as front and rear flaps 202 rest on inclined edges 28 and 128. In the bookstand configuration, flaps 20 and 120 may be approximately at an angle of 10 to 170 degrees each other.

As best seen in FIG. 6, when book 200 is not in use, instant invention 10 lays flat within book 200 when in the bookmark configuration. It is noted that instant invention 10 conforms to the shape of book 200 and is thin enough so as to not damage book 200.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bookmark and stand, comprising first and second flaps (20 and 120) and a single bridge assembly (60), said first and second flaps (20 and 120) each comprise a wall section (22 and 122), a base section (48 and 148), and a hook section (44 and 144), each said wall section (22 and 122) is defined by a base edge (46 and 146), a rear edge (24 and 124), a first top edge (26 and 126), a first inclined edge (28 and 128), and a second inclined edge (30 and 130), extending from said first top edge (26 and 126) are said first inclined edges (28 and 128) respectively, and extending from said first inclined edges (26 and 126) are said second inclined edges (30 and 130) respectively, each said base section (48 and 148) is defined by its respective said base edge (46 and 146) and an intermediate edge (32 and 132), said single bridge assembly (60) comprises a single second top edge (62), a single bottom edge (64), and a single bridge (66), said single bridge assembly (66) connects to each said rear edge (24 and 124), said first and second flaps (20 and 120) have a sheet configuration and are made of a substantially rigid material to support a book when in a bookstand configuration, and also may lay flat within said book when in a bookmark configuration, whereby said first and second flaps (20 and 120) and said single bridge assembly (60) conform to a shape of said book and are thin enough so as to not damage said book, each said base edge (46 and 146) is straight, extending upwardly and perpendicularly from an end of each said base edge (46 and 146) is its respective said rear edge (24 and 124), extending perpendicularly from each said rear edge (24 and 124) is its respective said first top edge (26 and 126), each said first top edge (26 and 126) extends downwardly to its respective said first inclined edge (28 and 128) that in turn also extends downwardly to its respective said second inclined edge (30 and 130), each said intermediate edge (32 and 132) extends from its respective said second inclined edge (30 and 130) to respective interior edge (34 and 134) of its respective said hook section (44 and 144), each said base edge (46 and 146) and its respective said intermediate edge (32 and 132) are parallel, said single bridge assembly (60) is taller in height than said first inclined edge (28 and 128) and said second inclined edge (30 and 130).

2. The bookmark and stand set forth in claim 1, further characterized in that each said hook section (44 and 144) comprises said interior edge (34 and 134), a bottom hook edge (36 and 136), a tip (38 and 138), a top hook edge (40 and 140), a front edge (42 and 142), and its respective said base edge (46 and 146), each said interior edge (34 and 134) extends upwardly from said intermediate edge (32 and 132) at a predetermined obtuse angle to its respective said bottom hook edge (36 and 136), and each said front edge (42 and 142) is straight and perpendicular to its respective said base edge (46 and 146), and said bottom hook edge (36 and 136) is approximately perpendicular to said interior edge (34 and 134).

3. The bookmark and stand set forth in claim 2, further characterized in that said first and second flaps (20 and 120) are a mirror image of each other.

4. The bookmark and stand set forth in claim 3, further characterized in that each said first inclined edge (28 and 128)

are substantially perpendicular to its respective said interior edges (34 and 134) to provide a comfortable angle and support for said book, each said base edge (46 and 146) are longer in length than its respective said rear edges (24 and 124), each said base edges (46 and 146) are longer in length than its respective said first top edges (26 and 126), each said base edges (46 and 146) are longer in length than its respective said first inclined edges (28 and 128), each said base edges (46 and 146) are longer in length than its respective said second inclined edges (30 and 130), each said base edges (46 and 146) are longer in length than its respective said intermediate edges (5 and 132).

5. The bookmark and stand set forth in claim 4, further characterized in that said single bridge assembly (60) is made of a flexible material to allow said first and second flaps (20 and 120) and said single bridge assembly (60) to conform to a shape of said book (200) and are thin enough so as to not damage said book (200) while flat within said book (200) when in a bookmark configuration, each said hook sections (44 and 144) have a cooperative shape and dimension to secure said book (200) in place when in a bookmark configuration, and each said interior edge (34 and 134) has cooperative dimensions to allow said book (200) of various widths to rest upon them as said book (200) also rests on said first inclined edges (28 and 128).

* * * * *